US005079348A

United States Patent [19]

Clare et al.

[11] Patent Number: 5,079,348

[45] Date of Patent: Jan. 7, 1992

[54] FILM-FORMING SIZE COMPOSITION

[75] Inventors: Kenneth Clare, Vista; Philip E. Winston, Jr., San Diego; Harold D. Dial, San Diego; Theresa M. Ortega, San Diego, all of Calif.

[73] Assignee: Merck & Co., Inc., Rahway, N.J.

[21] Appl. No.: 356,812

[22] Filed: May 24, 1989

[51] Int. Cl.[5] ..... C08L 5/04; A23L 1/04

[52] U.S. Cl. ..... 536/3; 8/561; 536/114; 536/123; 162/175; 162/176; 162/177; 162/178; 106/205; 106/208; 106/209; 106/210; 106/170; 106/197.2; 106/162

[58] Field of Search ..... 106/205, 208, 209, 210, 106/170, 197.2, 162; 162/175, 176, 177, 178; 8/561, 7, 91; 536/3, 114, 123

[56] References Cited

U.S. PATENT DOCUMENTS

| | | | |
|---|---|---|---|
| 4,257,768 | 3/1981 | Racciato et al. | 536/114 |
| 4,257,816 | 3/1981 | Yin et al. | 106/205 |
| 4,363,669 | 12/1982 | Cottrell et al. | 106/205 |
| 4,693,728 | 9/1987 | Clare et al. | 106/205 |
| 4,792,415 | 12/1988 | Colegrove | 536/114 |
| 4,859,208 | 8/1989 | Clare et al. | 536/123 |
| 4,894,250 | 1/1990 | Musson et al. | 426/574 |
| 4,911,946 | 3/1990 | Singer et al. | 426/602 |
| 4,952,686 | 8/1990 | Renn et al. | 426/658 |
| 4,979,989 | 12/1990 | Ridoux | 106/205 |

*Primary Examiner*—Ronald W. Griffin

*Attorney, Agent, or Firm*—Gabriel Lopez; Richard S. Parr; Charles M. Caruso

[57] ABSTRACT

A film forming composition useful as a paper size is described which includes 1–20 parts, preferably 2–15 parts, by weight of a gum selected from the group consisting of xanthan gum, rhamsan gum, welan gum and mixtures thereof; 3–20 parts, preferably 5–17 parts, by weight of a water soluble alginate; and 60–100 parts, preferably 70–90 parts, by weight of starch, polyvinyl alcohol or carboxymethylcellulose, with the gum:alginate ratio being not greater than 1:1, preferably not greater than 1:2. The balance of the composition will primarily be water. Additives such as sodium hexametaphosphate may also be present.

12 Claims, No Drawings

FILM-FORMING SIZE COMPOSITION

BACKGROUND OF THE INVENTION

Sizes have been applied to paper surfaces for many years. The principal function of a size is to reduce absorbency of the paper surface, which in turn makes the surface more resistant to spreading of applied inks. The inks then do not run or smear and printed patterns applied to the surfaces remain sharp and clearly defined. In addition sizes may provide stiffness, smoothness, weight and luster to the surface.

In the past most sizes have been based on starch, while others have been based on polyvinyl alcohol (PVA) or carboxymethylcellulose (CMC). Neither, however, is a particularly good film former, so that such sizes have tended to produce porous surface coatings on the paper. Thus printed patterns applied to the paper have been properly defined in some areas, but in those areas where the coating has been more porous, the inks have become mottled (i.e., unevenly distributed on the paper surface), a condition commonly referred to as "poor ink hold out." In order to overcome this problem, the paper manufacturers have generally applied an excess of size, to insure that all areas of the paper surface would be adequately coated and porosity would be minimized. This of course results in unnecessary coating thickness in many areas of the paper and an uneconomical use of size compositions.

The use of excess size also produces problems with unwanted paper penetration. Where the size coating is unduly thick due to higher concentrations, drying is more difficult, leading to cracking or crazing of the surface film.

It would therefore be of advantage to have a size which had good film forming properties, such that the size could be applied in an even, non-porous coating across the paper surface. Having such a coating would permit proper sizing of the paper with the optimum quantity of size and would also allow control of paper penetration by the size.

SUMMARY OF THE INVENTION

The invention herein is a film forming composition useful as a paper size which composition comprises 1–20 parts, preferably 2–15 parts, of a gum selected from the group consisting of xanthan gum, rhamsan gum, welan gum and mixtures thereof; 3–20 parts, preferably 5–17 parts, of a water soluble alginate; and 60–100 parts, preferable 70–90 parts, of starch, polyvinyl alcohol, carboxymethyl cellulose or mixtures thereof, with the gum:alginate ratio being not greater than 1:1 preferably not greater than 1:2. The balance of the size will primarily be water, but may also include various additives. (All percentages and parts defined herein are by weight unless stated to be otherwise.)

DETAILED DESCRIPTION

The sizes of the present invention provide for excellent film formation and controlled penetration. They are based on the unexpected discovery that combinations of components which themselves individually provide limited porosity control and film formation are when combined in specific proportions able to form non-porous, well leveled size coatings on paper, which coatings take printing inks readily and provide excellent definition of printed patterns.

The first component of the size compositions herein is a gum selected from the group consisting of xanthan gum, rhamsan gum, welan gum or mixtures thereof.

By the term "xanthan gum" as used herein is meant the extracellularly produced gum made by the heteropolysaccharide-producing bacterium *Xanthomonas campestris* by the whole culture fermentation of a variety of conditions of a medium comprising a fermentable carbohydrate, a nitrogen source and other appropriate nutrients. Examples of commercially available xanthan gum are "KELTROL® T", "KELTROL® F," "KELZAN® AR" and "KELZAN®", available from Kelco Division of Merck & Co., Inc.

Processes for producing xanthan gum are well known in the art and are described in a number of patents including U.S. Pat. Nos. 4,316,012, 4,352,882, 4,375,512, 3,671,398, 3,433,708, 3,271,267, 3,594,280, 3,591,578, 3,391,061, 3,020,206, 3,481,899 and 3,391,060 as well as British Patent No. 1,448,645.

A preferred form of xanthan gum utilized in the invention that which has been clarified by any of several known clarification processes. Clarified xanthan gum such as "KELTROL® T" and "K5B143" (products of Kelco Division of Merck and Company, Inc.) is commercially available. As defined herein clarified xanthan gum has a 1% (wt./vol.) solution (deionized water) transmittance of not less than 85%, measured on a Bausch & Lomb "SPECTRONIC" photometer, model 21 (600 mm., 25° C., 10 mm. cell).

Also useful in this invention is welan gum. Welan gum is a water-soluble polysaccharide produced by the fermentation of Alcaligenes spp. Welan gum is stable over a wide range of viscosities and at temperatures up to about 150° C. (300° F.). Welan gum is described in U.S. Pat. No. 4,342,866. A typical welan gum is that available commercially under the trade designation "K1A96" from Kelco Division of Merck & Co., Inc.

The third gum useful in the present invention is rhamsan gum. Rhamsan gum is a microbial polysaccharide also produced from Alcaligenes spp. which is highly pseudoplastic, has a stable viscosity over a range of pH of 2–12 and at temperatures up to about 100° C. (212° F.) and is compatible with high concentrations of salt. Rhamsan gum is described in U.S. Pat. No. 4,401,760. Rhamsan gum is commercially available; a typical example is a gum sold under the trade designation "K1A112" by Kelco Division of Merck & Co., Inc.

The viscosity of the gum to be used will be a simple matter of selection based on the nature of the paper system into which the size is to be incorporated.

In the present invention the gum will be present as 1–20 parts of the size composition, measured on a dry basis. Preferably the gum will be present as 2–15 parts, more preferably 2–3 parts, of the size composition.

There are a wide variety of alginates useful in this invention. These are described in detail by I. W. Cottrell and P. Kovacs in "Alginates," as Chapter 2 of Davidson, ed., *Handbook of Water-Soluble Gums and Resins* (1980). Most preferred herein are the sodium alginates, such as those sold commercially under the trademarks "KELTEX®" and "KELGIN®" by Kelco Division of Merck & Co., Inc.

The alginate will be present as 3–20 parts, preferably 4–17 parts, of the composition.

The gum:alginate ratio must be not greater than 1:1, and preferably not greater than 1:2. Greater ratios (where the gum content exceeds that of the alginate)

result in a degradation of the size film. Generally the alginate content will substantially exceed the gum content; ratios in the range of 1:2.5–1:9 may readily be used.

The starch, polyvinyl alcohol or carboxymethylcellulose used in the sizes of this invention may be any commercial material commonly known as being of the type useful in sizes. Many such products are available and are widely described in the literature; see, e.g., Carter, ed., *Making Pulp and Paper* (Crown Zellerbach, 1968), esp. pp. IV-25 et seq. and Hawley, ed., *The Condensed Chemical Dictionary* (8th ed., 1971). Mixtures of these materials may be used.

In the present invention the starch, PVA, CMC or mixture thereof will be present as 60–100 parts, preferably 70–90 parts, of the composition. (For convenience herein these materials will sometimes be referred to collectively as "starch.")

Generally the gum, alginate and starch will make up only about 8–10 percent of the actual size, with the balance being primarily water. There may in addition be other conventional sizing additives in the size, as long as they do not detrimentally affect the film forming function of the gum/alginate/starch combination. Such additives may include colorants, dispersants, surfactants and so forth. One preferred additive is sodium hexametaphosphate (sold commercially under the trademark CALGON ® by Calgon Corporation) as a sequestrant for calcium in the water present in the composition, to prevent unwanted gellation of the gum or alginate. The amount of the sodium hexametaphosphate present will be on the order of about 20–30% of the alginate. Other sequestrants include salts of ethylenediaminetetraacetic acid (EDTA) and sodium citrate.

It is believed that the compositions of this invention are effective because in the temperature range of use for size application (about 100°–160° F./37°–72° C.) the gum is more pseudoplastic than the other components, i.e., it imparts low viscosity at operable shear rates in a size press, thus enhancing "runability," but has fast recovery of initial viscosity to maintain a larger concentration of size on the paper surface. This in turn provides greater rheologic stability to the composition than would be obtained in the absence of the gum. Thus even though the gum itself is not a good film former, it enhances the film forming properties of the overall composition as a size.

Compositions of this invention using rhamsan and xanthan gum were used to size test samples of paper and compared with a conventional starch size. Table I below summarizes the data obtained in the rhamsan gum tests. The starch was a commercial cooked starch, the alginate was a commercial alginate available under the trade designation "KELGIN ® QH," and the gum was commercial rhamsan gum. The balance of each composition was water.

TABLE I

| Test No. | Component, wt. % | Dry Pick-Up, g/m$^2$ | Densometer (Average) Gurley seconds |
|---|---|---|---|
| 1 | Starch, 8.0 | 0.76 | 660 |
| 2 | Alginate, 2.0 | 0.30 | 130 |
| 3 | Alginate, 2.0<br>Rhamsan gum, 0.1 | 0.33 | 175 |
| 4 | Alginate, 2.0<br>Rhamsan gum, 0.5 | 0.38 | 488 |
| 5 | Starch, 8.0<br>Alginate, 0.25<br>Rhamsan gum, 0.1 | 0.73 | 1100 |

Table II below summarizes the data obtained in the xanthan gum tests. The starch was a cooked hydroxethylated starch, commercially available under the trade designation "Penford 280," the alginate was a commercial alginate available under the trade designation "KELGIN ® QH," and the gum was commercial xanthan gum available under the trademark "KELZAN ®." Also present was the stated quantity of "CALGON ®" sodium hexametaphosphate ("NaHMP"). The balance of each composition was water.

TABLE II

| Test No. | Component, wt. % | Dry Pick-Up, g/m$^2$ | Densometer (Average) Gurley seconds |
|---|---|---|---|
| 6 | Starch, 8.0<br>Alginate, 0.80<br>NaHMP, 0.12 | 1.0 | 82 |
| 7 | Starch, 8.0<br>Alginate, 0.64<br>Xanthan gum, 0.16<br>NaHMP, 0.12 | 1.2 | 119 |
| 8 | Starch, 8.0<br>Alginate, 0.72<br>Xanthan gum, 0.08<br>NaHMP, 0.20 | 2.3 | 139 |
| 9 | Starch, 8.0<br>Alginate, 0.72<br>Xanthan gum, 0.08<br>NaHMP, 0.20 | 3.6 | 144 |

It will be evident from these data that neither alginate alone nor alginate combined separately with gum or starch produces an acceptable size. Combination of all three components, however, provides sizes with improved pick-up, improved density and reduced porosity.

It will be evident that there are many embodiments of this invention which, while not expressly set forth above, are clearly within the scope and spirit of the invention. The above description is therefore to be considered exemplary only, and the scope of the invention is to be limited only by the appended claims.

What is claimed is:

1. A film forming composition useful as a paper size which composition comprises 1–20 parts by weight of a gum selected from the group consisting of xanthan gum, rhamsan gum, welan gum and mixtures thereof; 3–20 parts by weight of a water soluble alginate; and 60–100 parts by weight of starch, polyvinyl alcohol, carboxymethyl-cellulose or mixtures thereof, and the balance water, with the gum:alginate ratio in the range of 1:2.5–1.9.

2. A composition as in claim 1 wherein said gum is present as 2–15 parts by weight.

3. A composition as in claim 1 wherein said gum is xanthan gum.

4. A composition as in claim 1 wherein said gum is rhamsan gum.

5. A composition as in claim 1 wherein said gum is welan gum.

6. A composition as in claim I wherein said alginate is present as 4–17 parts by weight.

7. A composition as in claim wherein said starch, polyvinyl alcohol, carboxymethylcellulose or mixture thereof is present as 70–90 parts by weight.

8. A composition as in claim 1 wherein said gum:alginate ratio is not greater than 1:2.

9. A composition as in claim 8 wherein said gum:alginate ratio is in the range of 1:2.5–1:9.

10. A composition as in claim 1 comprising 8.0 percent by weight starch, 0.25–0.80 percent by weight alginate, 0.08–0.5 percent by weight of xanthan gum, rhamsan gum, welan gum or mixtures thereof, and the balance water.

11. A composition as in claim 10 wherein said gum:alginate ratio is not greater than 1:2.

12. A composition as in claim 10 further comprising 0.12–0.20 percent by weight sodium hexametaphosphate.

* * * * *